US006310548B1

(12) United States Patent
Stephens, Jr. et al.

(10) Patent No.: US 6,310,548 B1
(45) Date of Patent: Oct. 30, 2001

(54) METHOD AND SYSTEM FOR DOOR ALERT

(75) Inventors: David Clark Stephens, Jr., Murray; Verlin Gene Russon, Lehi, both of UT (US); Darrel Levan Russon, Snowflake, AZ (US)

(73) Assignee: RS Group, Inc., Murray, UT (US)

( * ) Notice: Subject to any disclaimer, the term of this patent is extended or adjusted under 35 U.S.C. 154(b) by 0 days.

(21) Appl. No.: 09/580,067

(22) Filed: May 30, 2000

(51) Int. Cl.[7] ..... G08B 21/00

(52) U.S. Cl. ..... 340/540; 340/545.1; 340/547; 340/686.1

(58) Field of Search ..... 340/540, 545.1, 340/547, 310.06, 310.08, 686.1, 538

(56) References Cited

U.S. PATENT DOCUMENTS

| | | | | |
|---|---|---|---|---|
| 3,813,655 | * | 5/1974 | Allen et al. | 340/151 R |
| 3,820,102 | * | 6/1974 | Schubert | 340/276 |
| 4,427,975 | * | 1/1984 | Kinzie | 340/547 |
| 4,446,454 | * | 5/1984 | Pyle | 340/538 |
| 4,464,651 | * | 8/1984 | Duhame | 340/521 |
| 4,593,491 | * | 6/1986 | Carlson et al. | 49/13 |
| 4,609,910 | * | 9/1986 | Greringer et al. | 340/545 |
| 4,847,542 | | 7/1989 | Clark et al. | 318/560 |
| 5,157,383 | | 10/1992 | Fisher | 340/574 |
| 5,164,705 | * | 11/1992 | Dunagan et al. | 340/547 |
| 5,315,953 | | 5/1994 | Mullarkey, Jr. | 116/28 R |
| 5,402,105 | | 3/1995 | Doyle et al. | 340/539 |
| 5,459,450 | | 10/1995 | Beghelli | 340/538 |
| 5,499,014 | * | 3/1996 | Greenwaldt | 340/539 |
| 5,689,236 | | 11/1997 | Kister | 340/545 |
| 5,781,107 | | 7/1998 | Ji | 340/545 |
| 5,793,300 | * | 8/1998 | Suman et al. | 340/835.2 |
| 5,883,579 | | 3/1999 | Schreiner et al. | 340/686 |
| 6,002,332 | | 12/1999 | King | 340/545.1 |
| 6,049,285 | * | 4/2000 | Mangal et al. | 340/686.1 |

* cited by examiner

*Primary Examiner*—Daniel J. Wu
*Assistant Examiner*—Phung T Nguyen
(74) *Attorney, Agent, or Firm*—Madson & Metcalf

(57) ABSTRACT

The position of a monitored door is detected via a magnetic sensor. The detected positional information is digitally encoded and transmitted across power grid wiring within the home to at least one receiver. Based in part on the received positional information, a door alert indicator is activated. The system for door alert is also capable of monitoring multiple door or window openings via a network of interconnected sensors designed specifically for garages. Multiple door alert indicators may be placed throughout the home without interfering with the door status indicator system.

31 Claims, 8 Drawing Sheets

METHOD AND SYSTEM FOR DOOR ALERT

BACKGROUND OF THE INVENTION

1. The Field of the Invention

The present invention relates generally to a garage door status indicating system, and more particularly, to a door alert system that transmits a status signal to a remotely located receiver that indicates when the system or door is in an open or insecure state.

2. The Prior State of the Art

Most homes today include some type of garage area, which is often used for a variety of purposes including as a workspace and as a storage area for the home. In addition to the car, other valuable and sentimental items are often kept in the garage area, such as tools, supplies, parts, seasonal decorations, memorable keepsakes, bicycles, various storage boxes, reusable or recyclable odds and ends, and other bits and pieces. Access to the garage for the car is generally obtained through at least one large garage door, but the garage area may also be accessible to the homeowner through an external door. In addition to these doors, many homes have a door between the garage and the interior of the home. This interior door is not normally as secure or robust as the standard exterior doors to the home and may often be left unlocked. As such, an individual that obtains access to the garage also obtains access to the interior of the home.

Unfortunately, the position of a garage door is often not easily visible from the interior of the home. Often a user will return from an errand and forget to close the door. Or even worse, a user will intentionally leave the garage door while they work outside and forget to close the door when they are finished, retire in the evening leaving the garage door open all night long. Leaving a garage door open creates a crime of opportunity. For example, a passerby walks by and notices the free access to the garage and takes the opportunity to steal the available items. In other words, this is usually not a preplanned situation and is preventable. In many ways, an opportunistic thief using an open garage door also poses a more significant physical threat when the user is home because the thief has access to the residence. Presently, many monitoring systems only provide alerts for abnormal entry into the monitored house. But the majority of garage doors that are left open originate from a normal garage door opening and are left open merely as an oversight of the homeowner. As such, these monitoring systems are ineffective against the mere carelessness of a homeowner and do not prevent opportunistic criminals. What is needed is a door alert system to by notify the homeowner when a door in the garage area is left in an insecure or open state.

SUMMARY OF THE INVENTION

The present invention has been developed in response to the current state of the art, and in particular, in response to these and other problems and needs that have not been fully or completely solved by currently available garage door status indicating systems. The present invention relates to a door monitoring system that activates at least one remotely located indicator based in part on at least one detected sensor position of a monitored door. Thus, a preferred embodiment of the present invention provides a door alert sensor, a transmitter in communication with a remotely located receiver, and an indicator that is particularly useful for alerting the inhabitants of a home when a monitored door is left in an insecure or open position. The monitoring system of the present invention also indicates when communication between the transmitter and receiver is inappropriately interrupted.

One advantage of the present invention is to provide a door alert system for residential door status monitoring.

Another advantage of the present invention is the use of the home power network for efficient synchronized transmission of encoded positional information from the monitored door to an indicator.

Yet another advantage of the present invention is the low power consumption and high visibility of the monitoring and indicating system, despite the continuous monitoring of the system.

Another advantage of the present invention is the self-checking network of the receiver/indicator monitor modules.

Yet another advantage of the present invention is the added reliability of the system due to the high frequency synchronized digital transmissions between the sensor and indicator via the home power system.

Another advantage of the present invention is the added reliability of the sensor readings based in part on the placement of the sensor on the leading edge of the monitored door and in part on sensors flexible enough to compensate for normal garage door shifting.

Yet another advantage of the present invention is the ability to monitor multiple door or home openings and transmit a digitally encoded signal across the home power network to multiple receiver/indicator modules.

In summary, the foregoing and other objects, advantages and features are achieved with the improved door monitoring and status indicating system for use in a home garage setting. Embodiments of the present invention are particularly suitable for use with homes having one or more garage door openings or external doors requiring monitoring. For example, a home with two garage car doors and one-garage man door would require three monitoring units. The door alert system of the present invention enables a user to coordinate the monitored door status and transmit these signals to multiple receiver/indicator units placed at strategic locations throughout the home. Typically such indicating devices are particularly useful in kitchen and bedroom outlets as these provide a user an opportunity to view the indicator during food preparation and prior to going to bed.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and objects of the invention are obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
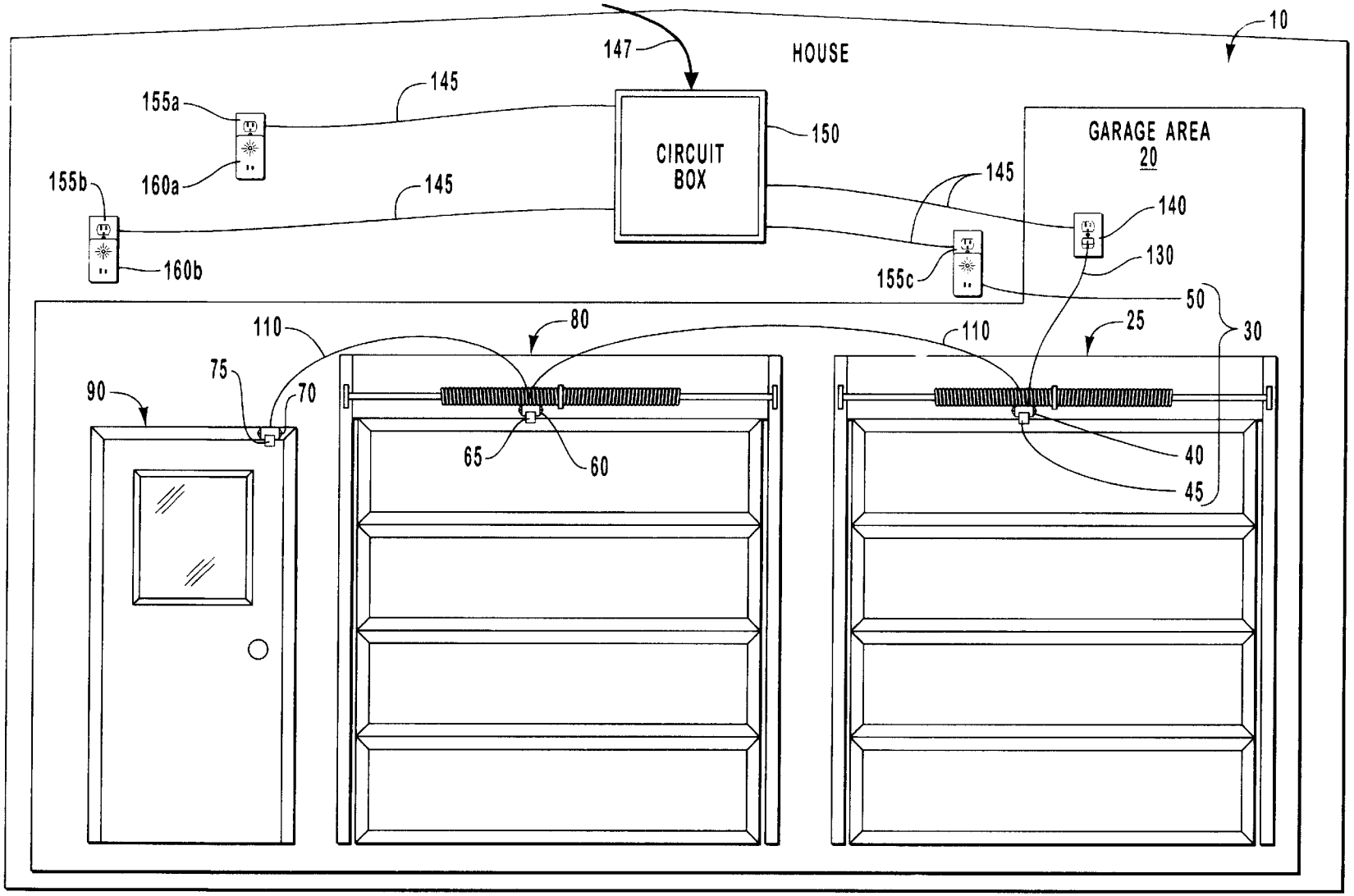
FIG. 1 illustrates one embodiment of a door detection system incorporated into a building.

Reference is first made to FIG. 1, an exemplary garage door system or environment that provides a suitable operating environment in which the present invention may be utilized or implemented. FIG. 1 is intended to be illustrative of potential systems that may utilize the present invention and is not to be construed as limiting. One embodiment of the present invention is door detection system 30, which is selectively incorporated into the building environment of FIG. 1. Door detection system 30 is useful in detecting the positional status of a monitored door. House 10 represents an acceptable building environment with a power grid network and at least one door to be monitored. The power grid network of House 10 is energized via external power network connection 147, preferably a single-phase power line connection from a single transformer on the nationwide power distribution network. The power grid network comprises circuit box 150, power distribution lines 145, and a plurality of electrical outlets 155 and 140. The exact configuration of the residential power grid network is dictated by local building codes, but power distribution lines 145 are generally configured into individual circuits that originate from circuit box 150. As such, the individual circuits are interconnected via circuit box 150. Power distribution lines 145 energize a variety of power outlets 155 from circuit box 150 and electrically interconnect all the power outlets 155. Typically power outlets 155 supply 120 volts to the sockets of the outlet, but special outlets such as those used for the range or dryer may provide additional voltage. Each circuit is protected and controlled by fuses or switches located in circuit box 150. Depending on the design of house 10 and local electrical codes, circuit box 150 may be located anywhere within house 10 including garage area 20.

Garage area 20 comprises garage door 25, garage door 80, man door 90, and is connected to the power grid network via electrical garage outlet 140. As with the other electrical outlets 155, garage outlet 140 contains a socket for receiving a plug and is connected to circuit box 150 via distribution line 145. As a result of the connection between garage outlet 140 and circuit box 150, signals may be transmitted from garage outlet 140 to a plurality of other electrical outlets 155 located anywhere in house 10 via the power grid network.

The garage area may also contain other relevant structures and devices, such as an automatic garage door opener and doorframes surrounding the doors. The doorframes typically include two side support beams and a heavy crossbeam. The construction of garage doors 25 and 80 can either be individual linked panels or single panel garage doors. In either case spring-loaded coils are often required to assist the homeowner in opening and closing the heavy garage door.

A garage door opener is generally attached to the upper portion of the garage door and the ceiling of the garage area and is powered via an electrical connection to the power grid network, such as garage outlet 140. One configuration of a garage door opener comprises a power supply, a motor for lifting the door, and a means for moving the door towards the motor of the garage door opener. Exemplary moving means include a track, rail, screw, chain, or other method of gradually opening and closing a garage door. Despite the ease using a garage door opener, homeowners often forget to close the garage door. Thus a door detection system 30 that warns a homeowner when a garage door is left in an open position is advantageous to the homeowner.

The basic configuration of door detection system 30 comprises sensor and transmitter module 40, receiver and indicator module 50, and activator 45. Sensor and transmitter module 40 comprises a transmitter electrically coupled to garage outlet 140 and a switch triggered by activator 45. Receiver and indicator module 50 comprises receiver circuitry and indicator circuitry.

Initially, door detection system 30 determines the position of the monitored door by evaluating the proximal relationship between activator 45 and the switch in sensor and transmitter module 40. The switch is either in a first or second position depending on whether activator 45 toggles the switch. In one configuration activator 45 is a magnet and the switch is a Reed switch that detects the presence of a magnetic field. For example, if the magnet creates a magnetic field close to the switch, then the door is closed. But if no magnetic field can be detected, then the door is open. Regardless of the detected position, the transmitter in sensor and transmitter module 40 will send an encoded signal to the receiver in receiver and indicator module 50. If the "door open" signal is decoded, the indicator circuitry is activated until an encoded "door closed" signal is received.

Sensor and transmitter module 40 is energized and electrical coupled to the power grid network via power cable 130. Receiver and indicator module 50 is energized and selectively electrically coupled to the power grid network via a plug. As both sensor and transmitter module 40 and receiver and indicator module 50 are electrically coupled to the power grid network, a synchronized transmission schedule may be created between the modules using the standard alternating current of the power grid network. More specifically, the modules may synchronize their timing circuitry according to the 60 Hz alternating current commonly attached to both modules. If receiver and indicator module 50 does not receive a signal within the transmission window, then the indicator circuitry may be activated to indicate that door detection system 30 is not properly configured. Once a signal is received by receiver and indicator module 50, the transmission window is reset, the modules are resynchronized, and the receiver and indicator module 50 waits for the next transmission from sensor and transmitter module 40.

The illustrated exemplary garage area 20 of FIG. 1 also depicts a plurality of doors commonly associated with a garage area. These doors may also be monitored by door detection system 30 via additional sensor devices 60 and 70. Although a plurality of monitored doors is illustrated, the present invention is most commonly practiced using sensor and transmitter module 40 to monitor activator 45 fastened to a single door. While sensors 40 and 60 monitor car doors of the garage, sensor 70 monitors a man door associated with the garage.

Exemplary sensors or switches that may be used by the door alert system include sensors, such as magnetic sensors, liquid sensors, electronic sensors, optical sensors, or other sensors configured to detect door position, and switches, such as latch switches, button switches, Reed switches, mercury switches, or other switches configured to detect position. The presently preferred exemplary system uses magnetic sensors that fall within the broader parameters of the term sensor. Such sensors are cited by way of example and should not be used to limit the scope of the present invention to specific positional sensors.

Exemplary doors or other openings that may be monitored by the door alert system include openings such as garage doors, man doors that open to the interior or exterior of the home, windows, sliding doors, loft doors, double doors, or other selectively closable openings.

In a multiple door monitoring system, the door closest to the electrical outlet will use sensor and transmitter module 40. The remaining doors are monitored by middle sensor 60 and end sensor 70. If there is more than one door to be monitored by the door detection system 30, then the sensor network must have one sensor and transmitter module 40 and one end sensor 70, but the system may have multiple middle sensors, such as middle sensor 60 The sensor network is serially interconnected to sensor and transmitter module 40 via cables 110. Cables 110 deliver sensor information from end sensor 70 and middle sensor 60 to sensor and transmitter module 40. Cables 110 also provide necessary power to sensors 60 and 70. The sensor network is electrically connected in a serial fashion such that if one sensor switch is opened, sensor and transmitter 40 will send an "door open" signal across the circuit box 150 to receivers and indicators 160. This particular open or closed configuration is chosen so as to minimize the overall risk to the homeowner.

Sensor and transmitter module 40 is electrically energized and attached to circuit box 150 by way of the selective coupling of power cord 130 to electrical outlet 140. Internal electrical outlets 155 and electrical outlet 140 are electrically coupled to the house power system via individual power lines 145.

In an alternative embodiment, each switch or sensor in the sensor network would send a unique signal corresponding to each monitored door across the power grid network, which, in turn, would activate a different indicator signal or indicator light that corresponded to each monitored door. Thus based on which indicator is activated the home owner would know which door was in an open or insecure position and be able to remedy the situation by closing the monitored door.

In one embodiment, activators 45, 65, and 75 are magnets located in close magnetic proximity to sensors located in modules 40, 60 and 70 when the monitored doors are in a closed position. In one configuration, the activator is placed on the leading edge of the monitor door in a manner such that any movement from the closed position may be interpreted as an open or insecure position by the sensor network. Furthermore, the activators do not return to the closed position until the door is completely closed, thereby avoided false "door closed" readings. The magnetic requirement is about 10 Amp turn in order to trigger the Reed switch in the sensor mechanism, this amount, however, is dependent on the type of magnetic sensor used and other magnetic field intensity values may be acceptable for other sensors.

Power outlet 140 is connected to the circuit box 150 via a standard residential power line 145. An exemplary house power system includes the electrical outlets within the home and on the exterior of the home all interconnected to a circuit box that is connected to a larger external power distribution network. As the majority of these signals are interconnected via the circuit box, the signals sent from the garage door monitor is transmitted through the house power system across power line 145 to power outlets 155*a* and 155*b*. The circuit box should be a single-phase circuit box without filtration between circuits, so the transmitted signal will not be blocked from the circuits.

When receiver and indicator units 160*a*and 160*b* are plugged into sockets 155*a* and 155*b*, which are part of the house power system, the indicator will be activated based in part on the signal transmitted by the sensor and transmitter 40. Receiver and indicator 160 may receive the transmitted signal across any outlet 155 attached to the circuit box 150. As illustrated, a plurality of receiver and indicator units 160 may receive the transmitted signal. This allows the homeowner to place indicators at common locations such as bedrooms, bathrooms, and kitchen.

A preferred indicator includes a light emitting diode (LED) that is activated when the garage or other monitored opening is in an insecure or open position. One desirable configuration extends the LED out from the housing so that a homeowner will have a viewing angle of at least 180 degrees. Other acceptable indicators include audio alarms, tactile alarms, and electrical outlet based alarms. An electrical outlet based alarm is illustrated in receiver and indicator unit 160 as a power outlet located below the illuminated LED. In this situation, a lamp or other device is plugged into the electrical outlet on the receiver and indicator unit 160, and if the garage is in the open or insecure position, the lamp or other device may flash to notify the homeowner. On other configurations of receiver and indicator unit 160, the electrical outlet is a convenient standard electric outlet with no direct connection to the indicator. Another configuration of receiver and indicator unit 160 does not include an outlet along with the indicator.

Multiple receiver and indicator modules 160 may be plugged into outlets 155 throughout the house power system and as these receivers do not transmit signals, it does not matter how many are plugged into the house power system. Nor does it matter if the outlets are placed in serial as opposed to a parallel fashion as illustrated.

Figure 2B:
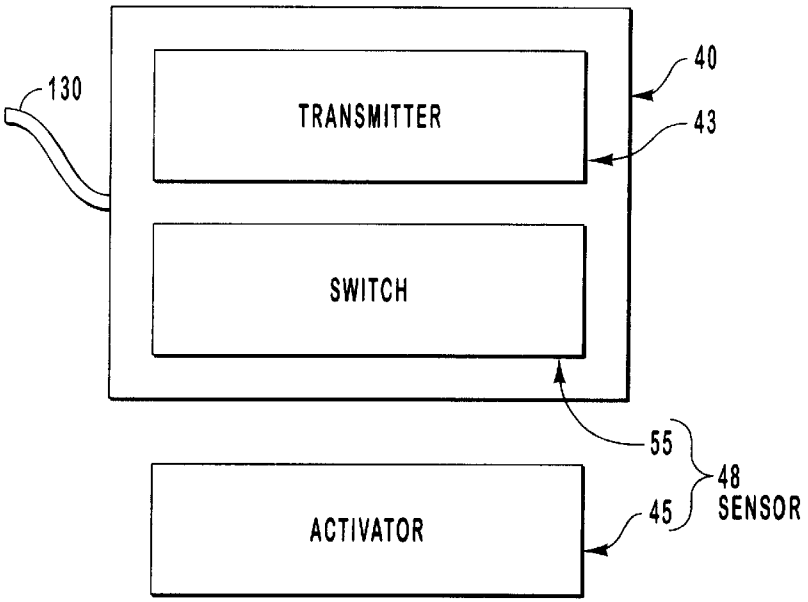
FIG. 2*b* is a block diagram of the sensor/transmitter for use in the system depicted in FIG. 1.
Figure 2A:
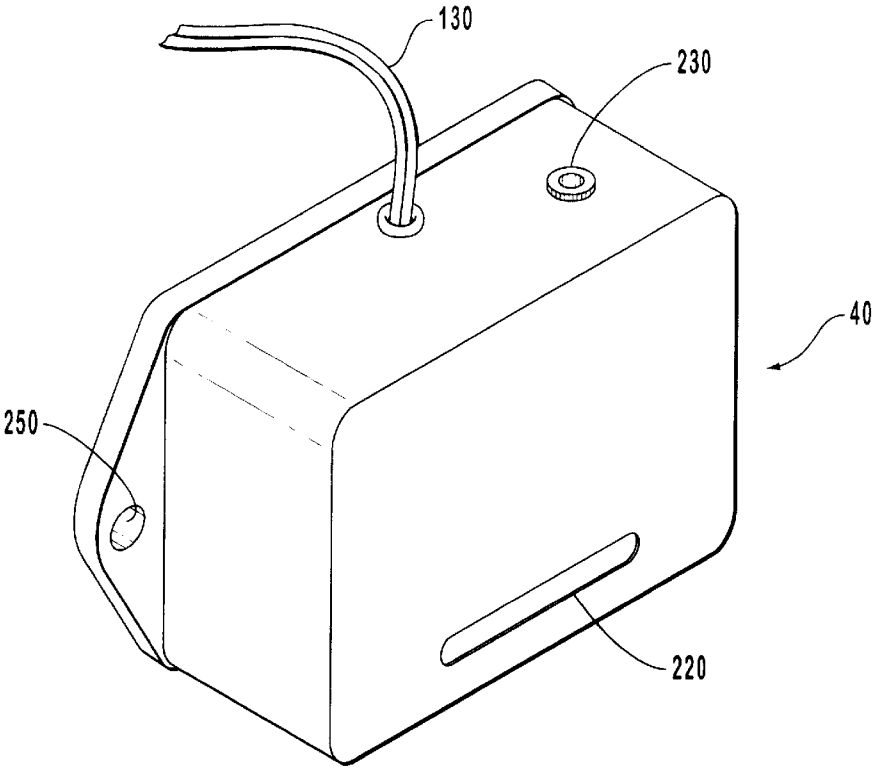
FIG. 2*a* is a perspective view of a sensor/transmitter for use in the system depicted in FIG. 1.

Reference is now made to FIG. 2*a,* illustrating a sensor/transmitter for use in an exemplary garage door system of the present invention. Sensor and transmitter module 40 comprises a housing with positional sensing channel 220, slots 250 for fastening sensor and transmitter module 40 to the cross member of the doorframe in close proximity of the garage door, connector socket 230 for interconnecting multiple sensors in a multiple door monitoring environment, and a power cord 130 for energizing the sensor and transmitter module 40 and for transmitting the detected positional information across the home power system or power grid network.

Sensor slot 220 indicates the position in which the activator, such as a magnet, should be placed for the sensor to function. Most garage doors open in an arcuate motion along support rails that control the path of the garage door. Unfortunately, even garage doors that follow rails or tracks are usually installed without the precision alignment required to properly place the supporting rail attachments into the woodwork frame around the garage door. Because of the weight of the average garage door and the imprecise installation of the rails, these garage doors will slide from one side to another to make up for the difference in the distance of the rails. With this flexibility in the rail or track system, the door may move laterally between two and three inches, but more typically within three quarters of an inch from one extreme to the other. This movement makes it difficult to make accurate measurements of the garage door position to determine if the door is open or closed. The lateral width of the sensor slot 220 allows the sensor to adapt to the flexibility of the garage door.

Sensor connection jack 230 allows for a connection to be created between multiple sensors. In one configuration of the present invention this connection both energizes and interconnects the sensors in a serial fashion. This configuration allows a "door open" signal to be detected if any sensor is open. The terms sensor connection jack, connector socket, miniature modular jack, physical/electrical sensor connector, fixed jack, alligator jack, and the like, connote a sensor connector that may have qualities such as those connectors having physical attributes described in FCC Part 68, Subpart F. Other acceptable sensor connection jacks include electronic receptacles, such as a television socket or jack, a stereo sound system socket, an antenna socket, a speaker socket, a cable socket, a VCR socket, a RGA socket, a video game socket, a telephone socket, a RJ-type socket, a computer Ethernet connection socket, a modem socket, or other peripheral socket. Specific terms such as RJ-type plugs, 6-pin miniature modular plug, 8-pin miniature modular plug, and similar terminology are all references to specific exemplary physical/electrical sensor connectors falling within the broader parameters of the term physical/electrical sensor connectors and are cited by way of example and should not be used to limit the scope of the present invention to specific connectors.

fastening means 250 illustrate a cavity capable of receiving screws, bolts, or other fastening means to affix sensor and transmitter module 40 to the frame of the garage door. Sensor and transmitter module 40 is preferably affixed near the leading edge of the monitored door. While FIG. 2*a* illustrates a semi-permanent fastening means there are many different acceptable methods for affixing the sensor in position, such as Velcro®, nails, staples, glue, paste, slot and groove, or other permanent or temporary fastening means. One of the factors to be considered when determining the type of fastener to be used is the variation or wobble present in the monitored garage door. Most garage doors are on rails that are installed without precision supporting attachments into the woodwork around the door. Because of the weight of the average garage door and the imprecise installation of the rails, most doors will slide from one side to another to make up for the difference in the distance of the rails. With this flexibility in the system, the door will move up to two inches and more typically within three quarters of an inch from one lateral extreme to the other. Sensor slot 220 supplies a magnetic detection range that allows the door to move within this expected shift and still provide the proper magnetic field and operate the system properly. Another method of providing for added flexibility is through a slotted connection for the magnet or other detection mechanism that allows the magnet to be shifted along the leading edge of the garage door so as to be centered over sensor slot 220. The means for fastening the magnet to the monitored door may also be adaptable in a horizontal and vertical fashion to allow for flexibility when installing on various door and doorframe types.

FIG. 2*b* is a block diagram illustrating the three fundamental circuitry blocks of the sensor and transmitter module 40. Specifically, FIG. 2*b* illustrates all of the circuitry components that should be located in garage area 20 for monitoring the doors. The preferred configuration of sensor and transmitter module 40 keeps transmitter 43 and switch 55 together in one housing energized by power cable 130. This configuration is preferred because it allows for easy and accurate installation. Most sensor 48 configurations require two parts, switch 55 and activator 45. For example a magnetic sensor may require a Reed switch and a magnet activator. Other sensors 48 are acceptable as long as they accurately reflect the position of the monitored door. Exemplary sensors that may be used by the door alert system include sensors, such as magnetic sensors, liquid sensors, electronic sensors, optical sensors, or other positional sensors.

In some configurations of the present invention, sensor 48 and transmitter 43 are separate units, with the transmitter 43 being attached to the power network via power cable 130 and in communication with sensor 48. This configuration enables sensor 48 to be remotely located from transmitter 43 and to combine switch 55 with activator 45.

In an improved separated configuration, the transmitter is integrated into a garage door opener. The garage door opener includes among other things, a motor for lifting the door and a power cable for energizing the motor. The integrated home power grid network transmitter uses the same power cable attached to the motor to send the transmissions to a receiver/indicator unit attached to the home power grid network.

One configuration of the integrated garage door opener can also include a short-range wireless receiver for activating the motor, wherein the short-range wireless receiver is in wireless communication with a remote transmitter. Signals from the remote transmitter in the integrated garage door opener system may directly activate the home power grid network transmitter, although the preferred configuration is for the power network transmitter to be activated by positional sensors.

Additional configurations of the integrated garage door opener systems include a door connector mechanically coupled to the garage door, a carriage selectively coupled to the door connector and to the motor via a movable track, screw, or chain. Optional configurations of the integrated garage door openers include positional switches activated or toggled by the movement of the carriage for determining when the garage door is open or closed. The positional switches activate the transmitter according to the location of the carriage along the garage opener track. Thereby using the existing positional detection switches as the positional sensor previously described in the present invention. In this way the separation of the sensor and transmitter units enable the door alert system to be integrated into a garage door opener. Preferred configurations of the integrated door alert system on new garage door opener installations place positional detection sensors on the leading moving edge of the garage door and other monitored doors. The activator may be placed on the carriage or affixed to the garage door. These separated transmitter and sensor configurations that integrate the power grid network transmitter into the garage door opener are important as they make the door alert system available for new installations.

Figure 3B:
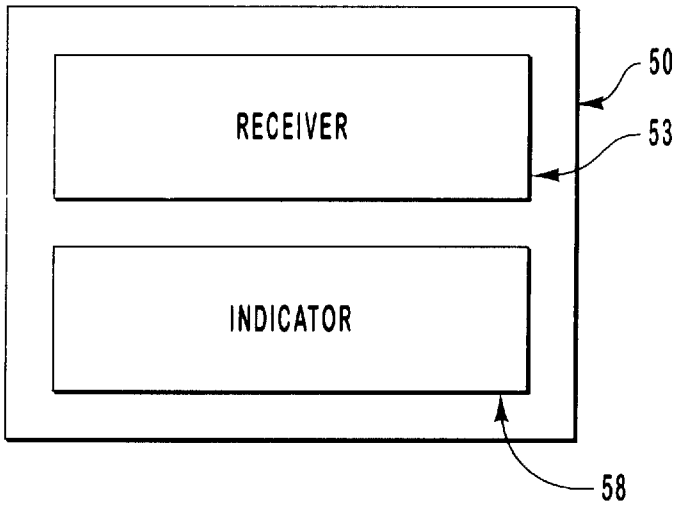
FIG. 3*b* is a block diagram of the indicator/receiver for use in the exemplary system depicted in FIG. 1.
Figure 3A:
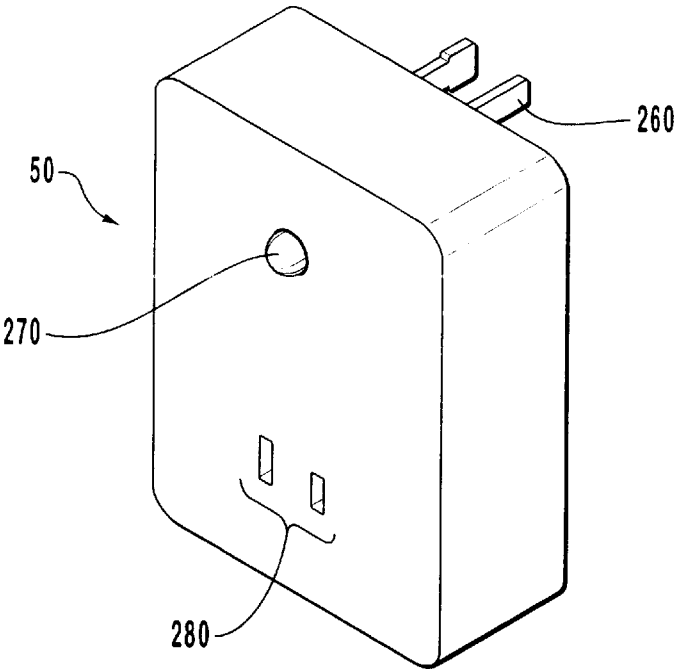
FIG. 3*a* is a perspective view of an indicator/receiver for use in the exemplary system depicted in FIG. 1.

Reference is now made to FIG. 3*a,* illustrating a receiver and indicator unit for use in an exemplary garage door system of the present invention. Receiver and indicator 50 comprises polarized plug 260, indicator 270, and polarized power socket 280. The illustrated power plug is a two-pronged plug, but may be replaced by a three-prong plug or other plug for use with variable power systems. Plug 260 should be configured for the local power network. More importantly, plug 260 is the connection of the receiver and indicator 255 to the residential power grid. The monitored plug 260 must have the electrical sensitivity to detect the signal transnitted by sensor and transmitter module 40. Power socket 280 relays power from plug 260 to the polarized outlet or socket. One configuration allows for socket 280 to be connected with an indicator circuit such that any device electrically attached to socket 280 will indicate an open or insecure state by flashing. For example, a lamp plugged into socket 280 would flash on and off if an open signal was received from sensor and transmitter module 40. Indicator 270 is illustrated as an LED, but may also be an audio, tactile, visual, or other indicator. The default position of receiver and indicator module 50 is the "on" position. This default "on" configuration assumes that if the power network transmissions are not functioning properly, indicator 270 should be activated to let the homeowner know that the positions of the monitored doors should be checked.

FIG. 3*b* is a block diagram illustrating the fundamental circuitry blocks of receiver and indicator module 50. Specifically, FIG. 3*b* illustrates all of the circuitry components that should be located in residential area of house 10 for door detection system 30. The preferred configuration of receiver and indicator module 50 keeps receiver 53 and indicator 58 together in one housing. This configuration is preferred because it allows for easy and accurate installation of door detection system 30 in three parts. However, as with the sensor and transmitter module 40, the receiver and indicator module 50 may also be separated. In one separated configuration a single receiver is in short-range wireless communication with multiple indicators, but as described this is costly relative to the combined door detection system 30.

Figure 4:
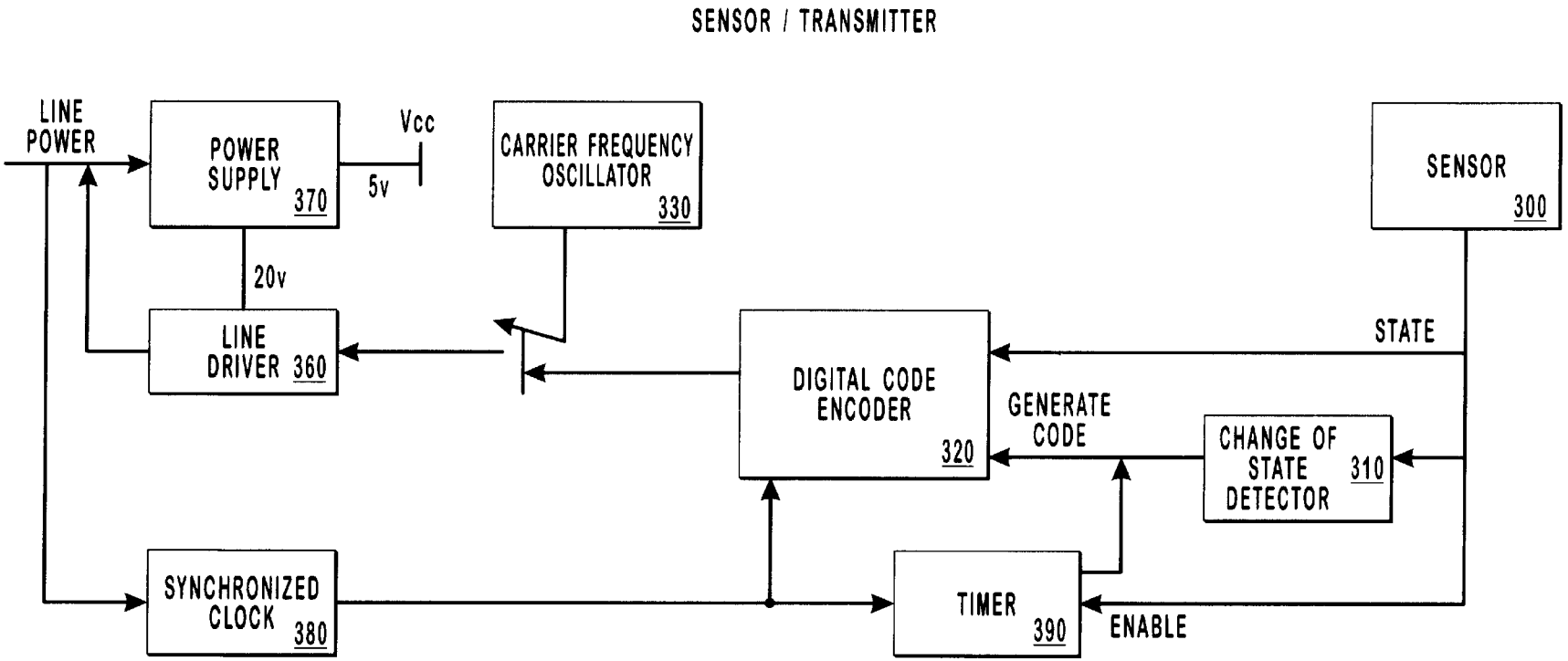
FIG. 4 is a detailed block diagram of sensor/transmitter modules.

Reference is now made to FIG. 4, illustrating a block diagram of a sensor/transmitter module. Sensor 300 detects the position of a monitored door. This information is made available to digital code encoder 320, change of state detector 310, and timer 390.

One configuration accomplishes positional detection by checking the state of a switch, such as a reed switch, to determine the door position. The state information is then available to digital code encoder 320. When digital code encoder 320 receives a "generate code" signal, encoder 320 reads the current state of sensor 300 and creates one of two serial binary codes indicating either the "door open" or "door closed" state. In the current configuration, both binary codes contain 4 bits each. Another sensor/transmitter configuration optionally accepts input from remote sensors that are monitoring multiple doors in preparation of the binary codes.

A "generate code" signal is always created when change of state detector 310 detects that the monitored door has opened or closed. An alternative method of creating the "generate code" signal via digital code encoder 320 is through timer 390. Timer 390 is in communication with synchronized clock 380 and activates the "generate code" signal when no intervening state change information is received. For example, if a door is left in a "closed" position for more than a predetermined time, timer 390 will reactivate digital code encoder 320 to refresh the "door closed" signal. In addition, when the door is in the closed position, timer 390 is enabled to create a "generate code" signal after a selected number of synchronized clock cycles. In one configuration, timer 390 is set to create the "generate code" signal approximately every 10 to 60 seconds, more preferably every 17 seconds. With this arrangement, the appropriate code is always transmitted immediately whenever the door is opened or closed. When closed, a "door closed" code is also transmitted every 10 to 60 seconds, more preferably every 17 seconds thereafter for as long as the door remains closed. When the door is opened, only the initial "door open" code is transmitted. In this configuration, nothing more is transmitted until the door again closes because the receiver/indicator units default to an active state when no signal is received. While the preferred time period does not require continuous transmission of positional signals across the home power grid to regularly update the indicators, other configurations of the present invention may use shorter or longer time periods in updating the positional codes without departing substantially from the present invention.

The line power energizes power supply 370 that provides the 5 volt Vcc for the logic circuits as well as 20 volts required for line driver 360. In addition, the line power is used by synchronized clock 380 to create a clock signal that is synchronized with clock signals present in the receiver indicator units. Synchronized clock 380 generates a clock pulse every time the 60 Hz line voltage crosses through zero volts. With a zero crossing in every cycle of the 60 Hz line voltage, 120 clock pulses per second are generated by the synchronized clock. This synchronized clock is based on the 60 Hz setting of traditional power transmission standards within the United States and may be selectively altered, depending on the standard alternating current of the power network applied to the door alert system.

The digitally encoded signal generated by digital code encoder 320 selectively adds a carrier signal to the line driver signal under the direction of digital code encoder 320 and carrier frequency oscillator 330. Specifically, when digital code encoder 320 is activated, it outputs each of the four bits of the binary code one at a time with each bit remaining present on its output for 1/120th second, the time period between clock pulses from synchronized clock 380. When a binary "1" is being transmitted, the carrier signal from the carrier frequency oscillator 330 is supplied to the line driver 360. Line driver 360 amplifies the carrier signal and superimposes it on the line power where it can be detected by receiver/indicator units elsewhere in the house. When a binary "0" or no code is being transmitted, the carrier signal is not supplied to line driver 360. When a "1" is being transmitted, it is further restricted to a window of time slightly shorter than the 1/120th second clock cycle to allow for timing discrepancies between the transmitter and receivers. As is clear to one skill in the art, this signal transmission may be accomplished through various other means, such as reversing the activation signal from "1" to "0" without departing from the invention.

Figure 5:
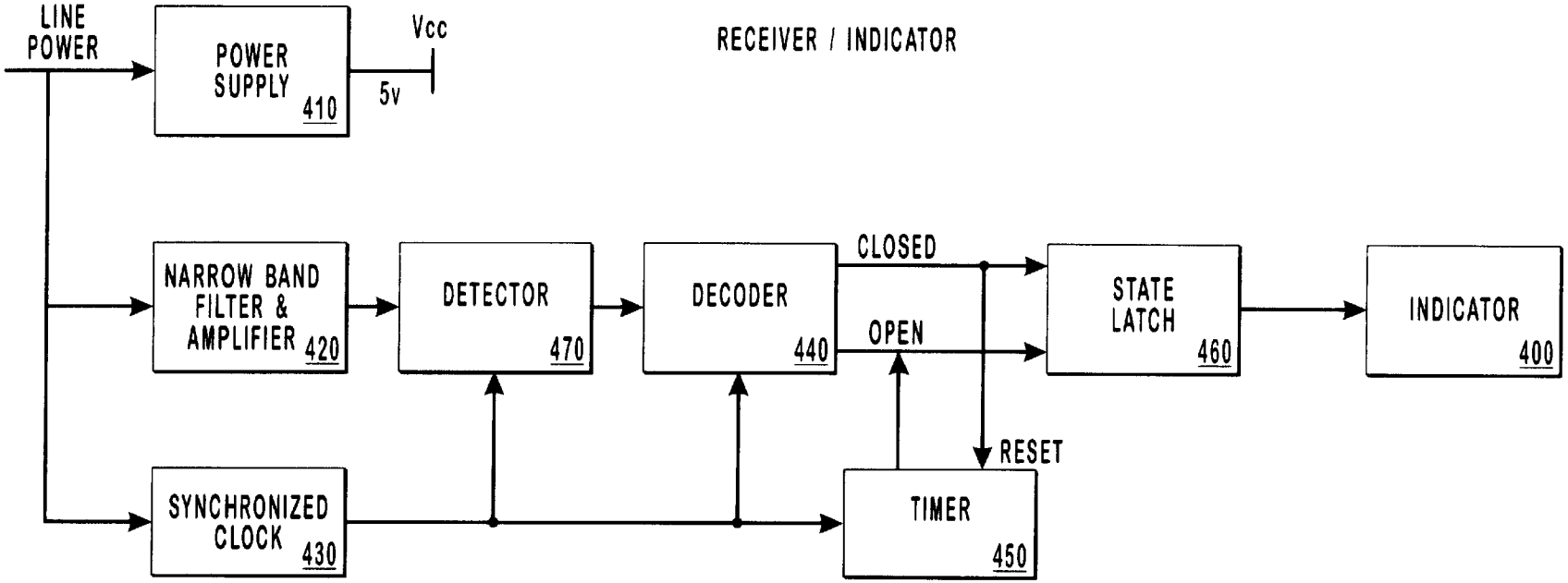
FIG. 5 is a block diagram of indicator/receiver modules.

Reference is now made to FIG. 5, illustrating an exemplary block diagram of indicator/receiver module. Line power is directed to power supply 410, narrow band filter and amplifier 420, and synchronized clock 430. Power supply 410 creates a five-volt power source for the rest of the receiver/indicator module. The synchronized clock 430 creates a clock signal, which is synchronized with the clock signal in the transmitter unit. As in the transmitter, synchronized clock 430 generates a clock pulse each time the 60 Hz line voltage crosses zero volts creating 120 clock pulses per second.

The narrow band filter and amplifier 420 senses the presence of the carrier frequency on the line power. More specifically, narrow band filter and amplifier 420 amplify the carrier frequency and attenuates others, allowing signals that are tuned to the frequency generated by sensor/transmitter to pass through to detector 470.

Detector 470 attempts to discriminate between valid signals and random noise that may pass through narrow band filter and amplifier 420. One method that detector 470 can use to accomplish this task is by essentially performing an integration function on the signal that passes through narrow band filter and amplifier 420. Throughout the synchronized clock cycle, preferably being approximately 1/120th of a second, the output of narrow band filter and amplifier 420 is allowed charge a capacitor. A binary "1" will steadily charge the capacitor through out the clock cycle, a zero will not. Random noise spikes being of short duration will cause only minimal charging. At the end of the clock cycle, the voltage on the capacitor is sampled. If it is above a certain threshold, it is considered to be a "1", below the threshold it is a "0". The capacitor is then discharged in preparation for the next clock cycle. Detector 470 passes valid transmission signals to Decoder 440.

Decoder 440 determines whether the detected signal matches a valid transmission signal, such "door open" or "door closed". The decoder 440 accepts the serial stream of binary bits from detector 470. When decoder 440 receives a "door open" code, it presents a pulse of one clock cycle duration on the open output line. When decoder 440 receives a "door closed" code, a similar pulse appears on the close output line. The pulses set state latch 460 to either of its two possible states, open or closed. If a "door closed" signal is decoded, timer 450 is reset and state latch 460 is set. An "open" signal is potentially generated in one of two ways, either via the expiration of transmission timer 450 or the reception and decoding of a valid "door open" signal.

The timer 450 is reset whenever the decoder detects a "door closed" code. Timer 450 times out in approximately 17 seconds at which time timer 450 sets the state latch to the open state. In order to keep the latch in the closed state, closed codes must be received every 17 seconds or less to reset the timer. On the other hand, the latch is placed in the open state and allowed to stay there with a single "door open" code or with no code at all after 17 seconds. The indicator simply displays the state of the state latch, where indicator "on" represents a "door open" in this configuration.

As previously mentioned, indicator 400 is preferably an LED. Indicator 400 may also involve a flasher circuit that interrupts line power to a power outlet. This interruption can be accomplished via a switch enabled by indicator 400 or other timed flash circuitry. Another configuration allows a power outlet to be attached to the line power so that both outlet sockets are not blocked by the receiver/indicator if the outlet socket is improperly installed. For example, when a polarized plug is installed upside down the receiver/indicator would block both outlet sockets. But, if an outlet socket is attached to the line power in the receiver/indicator, the homeowner is still afforded a power outlet. In some configurations the expiration of transmission timer 450 activates a "malfuction" indicator instead of the "door open" indicator.

When the transmitter and receivers depicted in FIGS. 4 and 5 are used where the line frequency differs from the 60 Hz of the United States power grid, the effect will be to change the timing of timer 390 in FIG. 4 and timer 450 in FIG. 5. When operating on a 50 Hz line frequency, for example, the "door closed" code will be transmitted approximately every 20 seconds as opposed to every 17 seconds with 60 Hz. However the timer in the receivers will correspondingly be slowed down and will only be expecting the "door closed" code every 20 seconds. The power supplies in transmitter and receivers may require adjusting some of the component values when operating at different A/C power frequencies. Extreme difference in line frequency may also require some component value changes in the synchronized clocks.

Figure 6:
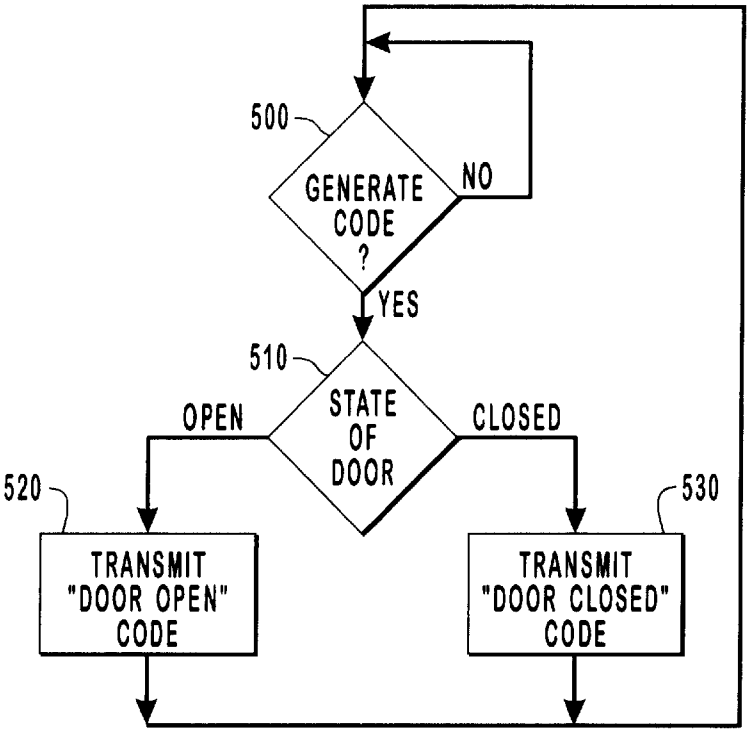
FIG. 6 is a flow chart of sensor/transmitter module.

With reference to FIG. 6, a flow chart for a sensor/transmitter module. Query block 500 determines whether a code should be generated. If no code is to be generated, control is returned to query block 500. Once the criteria indicate that a code should be generated, query block 510 determines the current state of the door and the appropriate code is generated either by execution block 520 generating a "door open" code or by execution block 530 generating a "door closed" code. In either case, control is returned to query block 500 after the code is sent.

The criteria upon which the decision is made to generate a code varies depending upon the particular configuration. For example, in a simple configuration, the decision to generate a code is based on a change of state in the door's position. Whenever the door opens or closes a code representing the door's current state is immediately generated and transmitted to the receiver/indicator(s). Upon receiving the appropriate code, the indicator(s) then produce the appropriate indication.

Another configuration generates a code like the first, whenever the state of the door changes such that the receiver/indicator(s) are immediately updated on the door's state. Additionally, when the door is closed, a "generate code" signal is produced periodically. That is, after a predefined length of time, a "generate code" signal is sent to block 510 so that a "door closed" code is transmitted periodically. In this configuration, the receiver/indicator(s) default to a "door open" indication after a period of time which is longer than the predefined retransmit period of the sensor/transmitter. If no "door closed" signal is received during that period, then the default "door open" is indicated. Each time a "door closed" code is received, a timer is reset to coordinate the timing between the transmitter and receiver. When the operator observes a "door open" indication on the receiver/indicator, but finds the door closed, he is alerted to a malfunction in the system whether in the electronic units themselves or in their installation.

In an improved configuration, a "generate code" signal is produced whenever the door state changes as in the previous two configurations, such that the receiver/indicator obtains immediate notification of the change of state. Additionally, a periodic "generate code" signal is produced independent of the door state. In this configuration, the receiver/indicator(s) are periodically notified of the current state. Such a notification indicates to a receiver/indicator that the sensor/transmitter is operating and codes are correctly transmitted. If the receiver/indicator fails to receive either code during the predetermined length of time, it determines that a malfunction has occurred and produces a malfunction indication.

Figure 7:
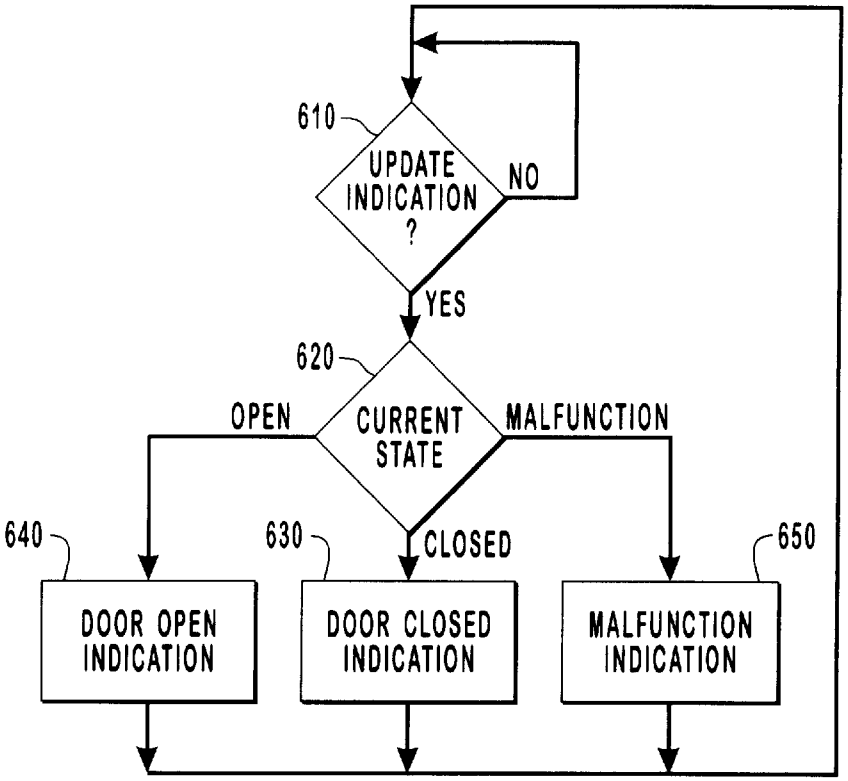
FIG. 7 is a flowchart of indicator/receiver module.

Reference is now made to FIG. 7, a flow chart for a receiver/indicator module. Query block 610 determines whether the state indication should be updated. If the state indication is not updated, then control is returned to query block 610. Once the criteria indicate that the state indication must be updated, query block 620 decides on which indication should be produced and transfers control to the correct execution block. Execution block 640 produces a "door open" indication, block 630 produces a "door closed" indication, and block 650 produces a malfunction indication. After indication is updated by one of the three execution blocks, then control is returned to query block 610.

The criteria used to query block 610 to update the indicator is related to the criteria producing a "generate code" signal in the sensor/transmitter of FIG. 6. For example, the configurations listed previously in FIG. 6 expect query block 610 in the receiver/indicator to produce an "update indication" signal as follows. In the first configuration, the indicator should be activated with the "update indication" signal. In this configuration, only "door open" or "door closed" indications exist.

In the second configuration, query block 610 produces an "update indication" signal whenever a "door open" or "door closed" code is received, as well as after the predetermined delay period has expired with no "door closed" code received. Upon expiration of the delay period, the default "door open" state is indicated. In this configuration, the malfunction indicator is the same as the door open indicator.

The third configuration is similar to the previous configurations, in that query block 610 produces an "update indication" signal whenever a code is received and the appropriate indication is given. Additionally, if no positional code is received during the predefined delay period, then an "update indicator" signal is produced by query block 610 and query block 620 determines that a malfunction in the system is present. Execution block 650 activates the "malfunction indicator," such as an LED of audio signal.

The indicators produced by the receiver/indicator may include, but are not limited to, the following: An audible alarm with different indicators including a lack of an alarm, different frequency sounds, or different pulsing patterns. The indicator may also illuminate different lights or LEDs with indicators being either on or off, on with different colors, or flashing on and off with different patterns. The indications may also be a switched outlet into which an external apparatus may be plugged, such as a lamp, a sound generating device, or any mechanical device. The outlet is then activated or deactivated based on the monitored door position.

Figure 8:
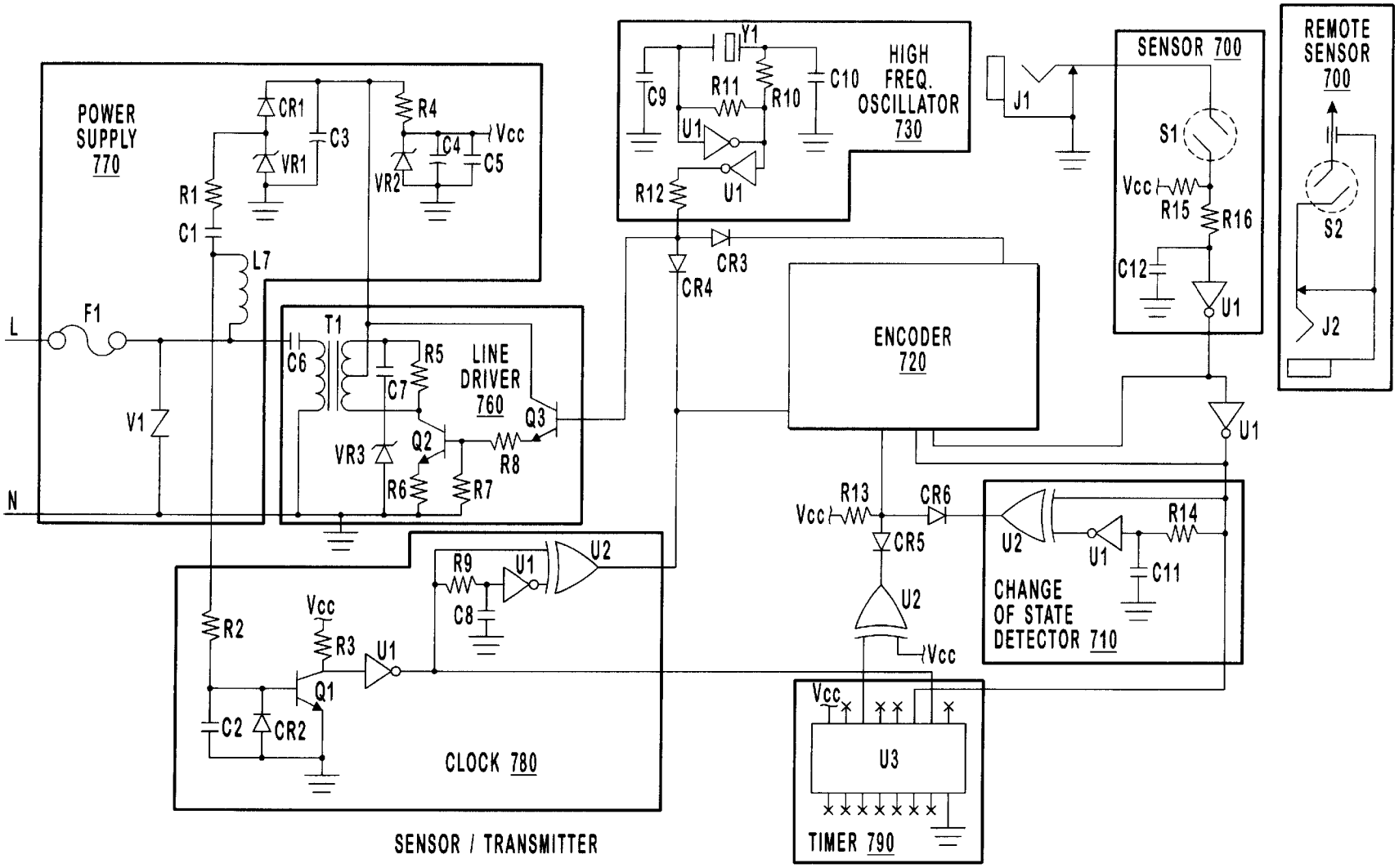
FIG. 8 is a circuit diagram of sensor/transmitter module.

Reference is now made to FIG. 8, illustrating a circuit diagram of sensor/transmitter module. Power supply 770 provides a 20-volt DC output to line driver 760 and a 5-volt DC output to power the other electronics. Sensor 700 and Remote Sensor 700 connected to J1 detect the current state of the circuit and send the state to encoder 720, change of state detector 710, and timer 790. Change of state detector 710 sends a "generate code" signal to encoder 720 when the state changes. Timer 790 is enabled when the state is "door closed." Timer 790 sends periodic "generate code" signals to the encoder 720 when enabled. Digital code encoder 720 generates the appropriate digital code based on the current state, when a "generate code" is received from either the change of state detector 720 or from the timer 790. The clock 780 generates a synchronized pulse or signal transfer window, during which a digit of digital code may send. Clock 780 generates a synchronized clock pulse based on line power transitions. The clock pulse drives and synchronizes timer 790 and carrier frequency oscillator. High frequency oscillator 730 generates a high frequency carrier oscillation signal. Line driver 760 receives the high frequency oscillation signals during the signal transfer window in which encoder 720 generates a digital "one." All other times the line driver 760 receives no signal. Line driver 760 superimposes the high frequency oscillation onto the line power when received from the high frequency oscillator 730. A list of exemplary components in Table 1 include:

TABLE 1

FIG. 8 Components

| Component Designation | Value | Component Designation | Value |
|---|---|---|---|
| R1 | 22 Ω | C1 | 2.2 μF |
| R2 | 220 kΩ | C2 | 0.0047 μF |
| R3 | 6.8 kΩ | C3 | 1000 μF |
| R4 | 1 kΩ | C4 | 100 μF |
| R5 | 18 kΩ | C5 | 0.1 μF |
| R6 | 10 Ω | C6 | 0.22 μF |
| R7 | 1 kΩ | C7 | 1500 pF |
| R8 | 510 Ω | C8 | 0.15 μF |
| R9 | 10 kΩ | C9 | 10 pF |
| R10 | 100 kΩ | C10 | 22 pF |
| R11 | 10M Ω | C11 | 0.047 μF |
| R12 | 12 kΩ | C12 | 0.1 μF |
| R13 | 10 kΩ | Q1 | 2N3904 |
| R14 | 10 kΩ | Q2 | 2SD946 |
| R15 | 2.7 kΩ | Q3 | 2N3904 |
| R16 | 68 Kω | J1 | Jack |
| CR1 | IN4002 | L1 | 100 μH |
| | MSCT | V1 | 140 V |
| CR2 | IN4148 | | VARISTOR4 |
| | DICT | Y1 | 120 KHz |
| CR3 | IN4148 | U1 | 74HC14 |
| CR4 | IN4148 | U2 | 74HC86 |
| CR5 | IN4148 | U3 | 74HC4040 |
| CR6 | IN4148 | U4 | 74HC165 |
| VR1 | IN4747 | S1 | CLA123 |
| | AMSCT | T1 | 4146–5021 |
| VR2 | IN4733 | F1 | TR145u |
| VR3 | IN4756 | | |

Figure 9:
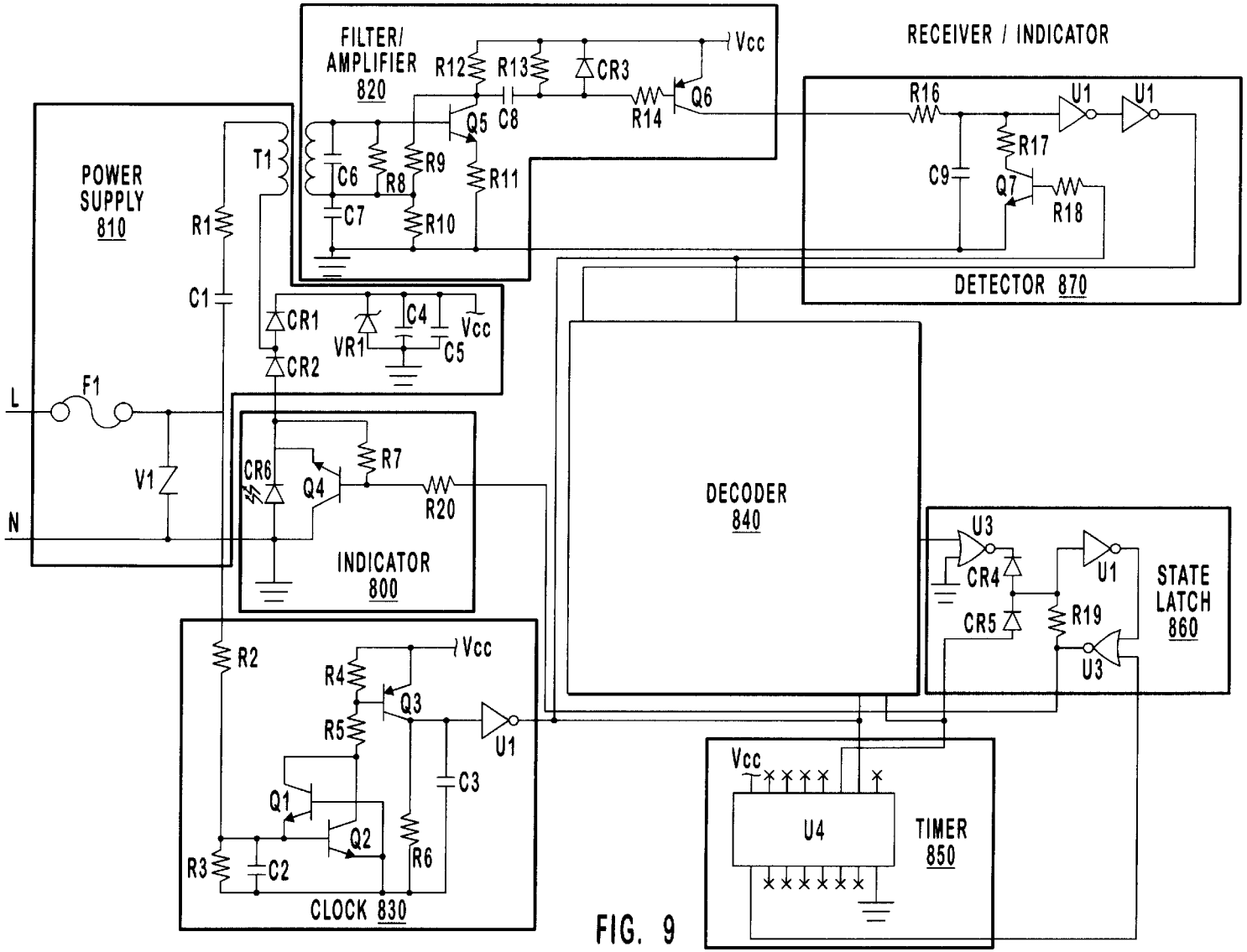
FIG. 9 is a circuit diagram of indicator/receiver module.

Reference is now made to FIG. 9, a circuit diagram of receiver/indicator module. Power supply 810 provides a 5-volt DC power to the electronic modules in the indicator receiver. The narrow band filter/amplifier 820 passes through high frequency signals, which are tuned to the frequency generated by the sensor/transmitter unit and blocks other frequencies. Filter/amplifier 820 amplifies the signals passed through the filter. Detector 870 charges a capacitor when the filter detects a tuned signal. Decoder 840 checks the series of incoming digits for matches to predefined digital codes. When a valid digital code is received, decoder 840 sets the state latch 860 to the appropriate state when a valid digital code is received. Clock 830 generates a synchronized clock pulse based on alternating line power transitions. Clock 830 synchronizes decoder 840 to transmissions from the sensor transmitter. Clock 830 drives and synchronizes timer 850. Timer 850 resets when a "door closed" signal is received from decoder 840. Timer 850 sends a periodic "door open" signal to the state latch 860, if not previously reset by a "door closed" signal from decoder 840. State latch 860 maintains the current state of the indicator. Indicator 800 provides the appropriate indication in accordance with the current state. While the preferred embodiment of the present invention activates the indicator in the default state, other configurations allow the indicator to only be activated upon detection of a "door open" signal. A list of exemplary components are provided in Table 2 below:

TABLE 2

FIG. 9 Components

| Component Designation | Value | Component Designation | Value |
|---|---|---|---|
| R1 | 100 Ω | VR1 | IN4733 |
| R2 | 220 kΩ | C1 | 0.68 μF |
| R3 | 2.7 kΩ | C2 | 0.15 μF |
| R4 | 10 kΩ | C3 | 1000 pF |
| R5 | 56 kΩ | C4 | 220 μF |
| R6 | 10 kΩ | C5 | 10 μF |
| R7 | 3.9 kΩ | C6 | 1000 pF |
| R8 | 82 kΩ | C7 | 1500 pF |
| R9 | 68 kΩ | C8 | 1000 pF |
| R10 | 47 kΩ | C9 | 0.022 μF |
| R11 | 470 kΩ | Q1 | 2N3904 |
| R12 | 4.7 kΩ | Q2 | 2N3904 |
| R13 | 56 kΩ | Q3 | 2N3906 |
| R14 | 3.3 kΩ | Q4 | 2N3904 |
| R15 | 270 kΩ | Q5 | 2N3904 |
| R16 | 12 kΩ | Q6 | 2N3906 |
| R17 | 1.5 kΩ | Q7 | 2N3904 |
| R18 | 10 kΩ | U1 | 74HC14 |
| R19 | 100 kΩ | U2 | 74HC20 |
| R20 | 10 kΩ | U3 | 74HC02 |
| CR1 | IN4002 | U4 | 74HC4040 |
| CR2 | IN4002 | U5 | 74HC164 |
| CR3 | IN4148 | T1 | 159-1010 |
| CR4 | IN4148 | V1 | 150 V |
| CR5 | IN4148 | | VARISTOR |
| CR6 | LED | F1 | TR145u |

In the preferred embodiment, the default state for the indicator system is "on," demonstrating that the homeowner should check the monitored doors and transmission system. Upon reception of an appropriate status signal the from the sensor transmitter device indicator will shut off. This arrangement of the door alert indicator system is important because it notifies the individual if there is a problem with the internal circuitry with the system and has them check the monitored door to ensure that it is closed. If the monitored door is closed, then the individual will know that there is something wrong with the monitoring system.

One embodiment of the present system includes a battery back up for the indicator that turns on in the absence of power supplied to the system so that the user will know that the system should be manually checked. Since the LED has low power consumption, operation using the backup may last for an extended period. Additional indicators can be provided to show power interruptions.

There accordingly has been described a system and method for remote and unattended testing and reporting to at least one receiver/indicator of the position of monitored doors by a sensor/transmitter. This system uses the home power network for efficient synchronized transmission of encoded positional information from the monitored door to the indicator. Various configurations of the monitoring system provide continuous monitoring, low power consumption, and high visibility of the monitored door status. The self-checking network of receiver/indicator monitor modules adds reliability and security to the homeowner. Transmission of high frequency synchronized digital signals between the sensor and indicator via the home power system increase the accuracy and efficiency of the monitoring system. Even the positioning of the sensor on or near the leading moving edge of the monitored door increases the accuracy of the positional readings for the monitoring system. The sensor and magnet attachments are designed to be flexible enough to compensate for normal garage door movement during use. Finally, one configuration of the present invention monitors multiple door or home openings and transmits a digitally encoded signal across the home power network to multiple receiver/indicator modules.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A status indicator system for use with a building having a door to be monitored and a power grid network which energizes a plurality of electrical outlets with an alternating current, the status indicator system comprising:

a switch operable between a first position and a second position, wherein the switch is in the first position when the door is at least partially open and being in the second position when the door is closed;

a transmitter electrically coupled with the switch, the transmitter being configured for electrical coupling with the power grid network of the building such that when the transmitter is electrically coupled with the power grid network the transmitter periodically transmits a first signal over the power grid network when the switch is in the first position and periodically transmits a second signal over the power grid network when the switch is in the second position;

a receiver having a plug configured to removably electrically couple with a select one of the plurality of electrical outlets energized by the power grid network, the receiver being configured to selectively receive the first signal and the second signal from the transmitter over the power grid network when the plug is electrically coupled with the select one of the plurality of electrical outlets; and an indicator electrically coupled with the receiver such that the indicator is energized by the receiver when the receiver receives a select one of the first and second signals.

2. The status indicator system as recited in claim 1, wherein the switch is a magnetically activated switch such that the switch is in the first position when magnetically coupled to an activator and in the second position when there is no magnetic coupling with the activator.

3. The status indicator system as recited in claim 2, wherein the activator is fastened to a first edge of the door, the first edge leading the door along a door path when the door moves from a closed to an open position and the first edge following the door when the door moves from the open to the closed position.

4. The status indicator system as recited in claim 2, wherein the magnetically activated switch is a reed switch and the activator is an about 10 Amp turn magnet.

5. The status indicator system as recited in claim 4, wherein there is no magnetic coupling when detected magnetic strength is less than about 10 Amp turns.

6. The status indicator system as recited in claim 1, wherein the indicator is a light emitting diode (LED) and an audible alarm that periodically produces sound when the door is open.

7. The status indicator system as recited in claim 6, wherein the indicator further comprises an electrical outlet socket coupled with switchable flasher circuitry such that when the indicator is energized the flasher circuitry periodically interrupts power supplied to the electrical outlet socket and when the indicator is not energized the electrical outlet socket operates without periodic power interruptions.

8. The status indicator system as recited in claim 1, wherein the first and second signals include high-frequency signals imposed on the alternating current of the power grid network.

9. The status indicator system as recited in claim 1, wherein the first and second signals are digitally encoded signals imposed on top of the alternating current of the power grid network.

10. The status indicator system as recited in claim 9, wherein the digitally encoded signals are synchronized high-frequency transmission windows imposed on top of the alternating current of the power grid network.

11. The status indicator system as recited in claim 1, further comprising a second switch operable between a first and a second position, the second switch being in the first position when a second door is at least partially open and being in the second position when the second door is closed, the second switch being electrically coupled in series with the switch and the transmitter such that when either the switch or the second switch are in the first position the transmitter transmits the first signal via the power grid network.

12. The status indicator system as recited in claim 11, wherein the transmitter transmits the second signal via the power grid network when both the switch and the second switch are in the second position.

13. The status indicator system as recited in claim 1, wherein the switch further comprises a plurality of operable switches, each switch monitoring a different door and each switch having a first and a second position, the plurality of switches being electrically coupled in series such that when any one of the plurality of operable switches is in the first position the transmitter transmits the first signal via the power grid network.

14. The status indicator system as recited in claim 13, wherein the transmitter transmits the second signal via the power grid network when all of the operable switches are in the second position.

15. A method for indicating the position of a door to a home owner inside a residence via a house power system, the method comprising the steps of:

sensing whether the door is open or closed;

transmitting positional information via the house power system;

detecting positional information via the house power system; and indicating positional information based in part on door position.

16. The method as recited in claim 15, further comprising the steps of:

encoding positional information;

periodically transmitting encoded positional information via high-frequency oscillation pulses on the house power system;

periodically receiving high-frequency oscillation pulses from the house power system containing encoded positional information; and decoding positioned informal information.

17. The method as recited in claim 15, wherein the step of indicating positional information further comprises activating an indicator unless the positional information associated with a closed door is detected.

18. The method as recited in claim 15, wherein the steps of transmitting and detecting positional information via the house power system is accomplished in part by synchronized timing that includes using coordinated clocks, which obtain cyclic coordination via an alternating current inherently found on the house power system.

19. A status indicator system for use with a door on a building having a power grid network, the status indicator system comprising:

sensing means for determining whether the door is open or closed;

transmitting means for encoding and transmitting periodic door status information on the power grid network;

detection means for decoding periodic door status information received from the power grid network;

indicating means for conveying positional information to a user based in part on door status information received from the detection means.

20. The door status indicator as recited in claim 19, wherein the sensing means is a sensing module located in the proximity of the door for detecting the positional status of the door, the sensing module comprising a switch and a switch activator.

21. The door status indicator as recited in claim 20, wherein the sensing module is a magnetic sensor, the switch activator comprising a permanent magnet selectively affixed to the top of the door and the switch comprising a Reed switch affixed to a frame surrounding the door, the switch being in magnetic communication with the activator when the door is closed, the switch also being in electrical communication with the transmitting means.

22. The door status indicator as recited in claim 20, wherein the sensing means is a network of electrically interconnected sensing modules individual located in proximity to a plurality of doors for detecting the status of the doors, each sensing module comprising a switch and a switch activator.

23. The door status indicator as recited in claim 19 wherein the sensing means is an activator in wireless communication with a switch.

24. The door status indicator as recited in claim 19, wherein the transmitting means is integrated into a garage door opener sharing a common connection to the power grid network; and wherein the sensing means are garage door opener switches positioned to determine whether the door is open or closed.

25. The door status indicator as recited in claim 19, wherein the transmitting means is a synchronized high-frequency oscillator in selective electrical communication with an electrical outlet.

26. The door status indicator as recited in claim 19 wherein the transmitting means digitally synchronizes a pulse with the detection means to activate the indicating means.

27. The door status indicator as recited in claim 19 wherein the detection means is selectively electrically coupled to the power grid network, the detection means activating.

28. The door status indicator as recited in claim 19 wherein the indicating means is activated if no door status information is received within a synchronized transmission time window.

29. The door status indicator as recited in claim 19 wherein the indicating means is a light emitting diode (LED) and a speaker, the speaker generating an audible alarm when the door is left open.

30. The door status indicator as recited in claim 29, wherein the indicating means further comprises an external outlet socket; and flasher circuitry that selectively interrupts power supplied to the socket when the indicating means is activated.

31. A method for indicating the status of a door located on a building having a power grid network which energizes a plurality of electrical outlets with an alternating current, the method comprising the acts of:

mounting a switch adjacent to the door such that the switch is in a first position when the door is at least partially open and the switch is in a second position when the door is closed, the switch being electrically coupled with a transmitter;

electrically coupling the transmitter to the power grid network such that the transmitter transmits a first signal over the power grid network when the switch is in the first position and transmits a second signal over the power grid network when the switch is in the second position; and removably inserting a plug located on a receiver into a select one of the plurality of electrical outlets energized by the power grid network, the receiver being configured to selectively receive the first signal and the second signal from the transmitter over the power grid network, an indicator being electrically coupled with the receiver such that the indicator is energized when the receiver receives a select one of the first and second signals.

* * * * *